US005462348A

United States Patent [19]

Ellingson et al.

[11] Patent Number: 5,462,348

[45] Date of Patent: Oct. 31, 1995

[54] DISHWASHER UTENSIL TRAY

[75] Inventors: David I. Ellingson; Daryl A. Michael, both of Newton, Iowa; William M. Nelms, Cleveland, Tenn.

[73] Assignee: Maytag Corporation, Newton, Iowa

[21] Appl. No.: 170,440

[22] Filed: Dec. 20, 1993

Related U.S. Application Data

[63] Continuation of Ser. No. 779,394, Oct. 18, 1991, abandoned.

[51] Int. Cl.[6] ..... A47B 77/14

[52] U.S. Cl. ..... 312/301; 312/311

[58] Field of Search ..... 312/301, 311, 312/334.21, 298, 299

[56] References Cited

U.S. PATENT DOCUMENTS

| | | | |
|---|---|---|---|
| 2,648,588 | 8/1953 | Ruspino . | |
| 2,739,025 | 3/1956 | Stoddard | 312/311 |
| 3,124,251 | 3/1964 | Guth . | |
| 3,126,098 | 3/1964 | Geiger et al. . | |
| 3,167,183 | 1/1965 | Claywell et al. . | |
| 3,181,924 | 5/1965 | Guth . | |
| 3,245,742 | 4/1966 | Lampman . | |
| 3,466,109 | 9/1969 | Kauffman et al. . | |
| 3,556,625 | 1/1971 | Kauffman . | |
| 3,727,622 | 4/1973 | Jacobs . | |
| 3,736,037 | 5/1973 | Doepke . | |
| 3,822,085 | 7/1974 | Clark . | |
| 3,837,917 | 9/1974 | Jenkins et al. . | |
| 3,861,769 | 1/1975 | Jenkins . | |
| 4,046,261 | 9/1977 | Yake . | |
| 4,183,437 | 1/1980 | Crawford et al. . | |
| 4,475,656 | 10/1984 | Collier . | |
| 4,917,248 | 4/1990 | Friskney . | |

OTHER PUBLICATIONS

"Miele Built–In Appliances", Booklet 423732; Nov. 1988.

*Primary Examiner*—Kenneth J. Dorner
*Assistant Examiner*—Gerald A. Anderson
*Attorney, Agent, or Firm*—Zarley, McKee, Thomte, Voorhees, & Sease

[57] ABSTRACT

A utensil holder or tray is provided for use in a dishwasher for holding odd-shaped utensils. The tray is movably supported upon the upper perimeter edge of a conventional dish rack. Rollers or hooks are provided for rollably or slidably supporting the tray upon the rack. Movement of the tray upon the rack is limited by detents or the like. The tray can be quickly and easily installed on or removed from the rack.

22 Claims, 5 Drawing Sheets

DISHWASHER UTENSIL TRAY

This is a continuation of application Ser. No. 07/779,394 filed on Oct. 18, 1991, now abandoned.

BACKGROUND OF THE INVENTION

Conventional dishwashers have a washing chamber with opposite sidewalls upon which upper and lower racks are movably mounted. The racks typically are a lattice structure adapted to hold such items as dishes, plates, glasses and cups for washing within the chamber. The racks are rollably or slidably supported by the sidewalls of the dishwasher so as to be forwardly movable to a position substantially outside the washing chamber for easy loading and unloading of the items. One of the racks normally has a silverware basket mounted or formed therein for holding knives, forks and spoons. However, the racks and silverware basket do not conveniently hold other odd-shaped utensils, such as spatulas, large serving spoons, ladles, tongs, long knives, mixer beaters, whips, and the like. Such odd shaped utensils often times cannot be vertically oriented in the silverware basket due to their length, and may fall through the lattice work structure of the racks when the racks are moved in and out of the washing chamber or from the force of water during the washing or rinsing cycles.

Some prior art dishwashers have provided extra baskets or trays for large utensils and the like. Typically, such supplemental baskets or trays are supported by the sidewalls of the washing chamber, similar to the racks. This manner of mounting the basket or tray to the dishwasher walls does not permit quick and easy removal of the basket or tray from the dishwasher when it is not needed, and increases the manufacturing cost, and thus the selling price, of the dishwasher.

SUMMARY OF THE INVENTION

A primary objective of the present invention is the provision of a utensil tray for holding utensils in a dishwasher.

Another objective of the present invention is the provision of a utensil tray for use in a dishwasher which is supported on a dish rack within the dishwasher.

A further objective of the present invention is the provision of a utensil tray which is slidably or rollably supported on the dish rack in a dishwasher so as to be movable on the rack.

Still another objective of the present invention is the provision of a utensil tray for a dishwasher which can be quickly and easily installed in or removed from the dishwasher.

Yet another objective of the present invention is the provision of a utensil tray for use in the dishwasher which will hold odd-shaped utensils for washing.

A further objective of the present invention is the provision of a utensil tray for selective use in a dishwasher which is economical to manufacture and which is durable in use.

The utensil tray or holder of the present invention is a latticework structure which is supported by the upper or lower rack in a dishwasher. The tray is a substantially rectangularly shaped and is supported on the dish rack for side-to-side or front-to-back movement on the rack. The tray may be movably supported on the rack in several different manners. Preferably, a plurality of rollers are provided on the tray for rollably supporting the tray on the upper perimeter edge of the rack. A track may be provided along the upper edge of the rack for guiding the rolling movement of the rollers. Alternatively, hooks may be provided on the tray for slidably engaging the upper edge of the rack. Stop means are provided for limiting the movement of the tray upon the rack. The tray can also be quickly and easily removed from the dishwasher.

DETAILED DESCRIPTION OF THE PREFERRED EMBODIMENTS

Figure 1:
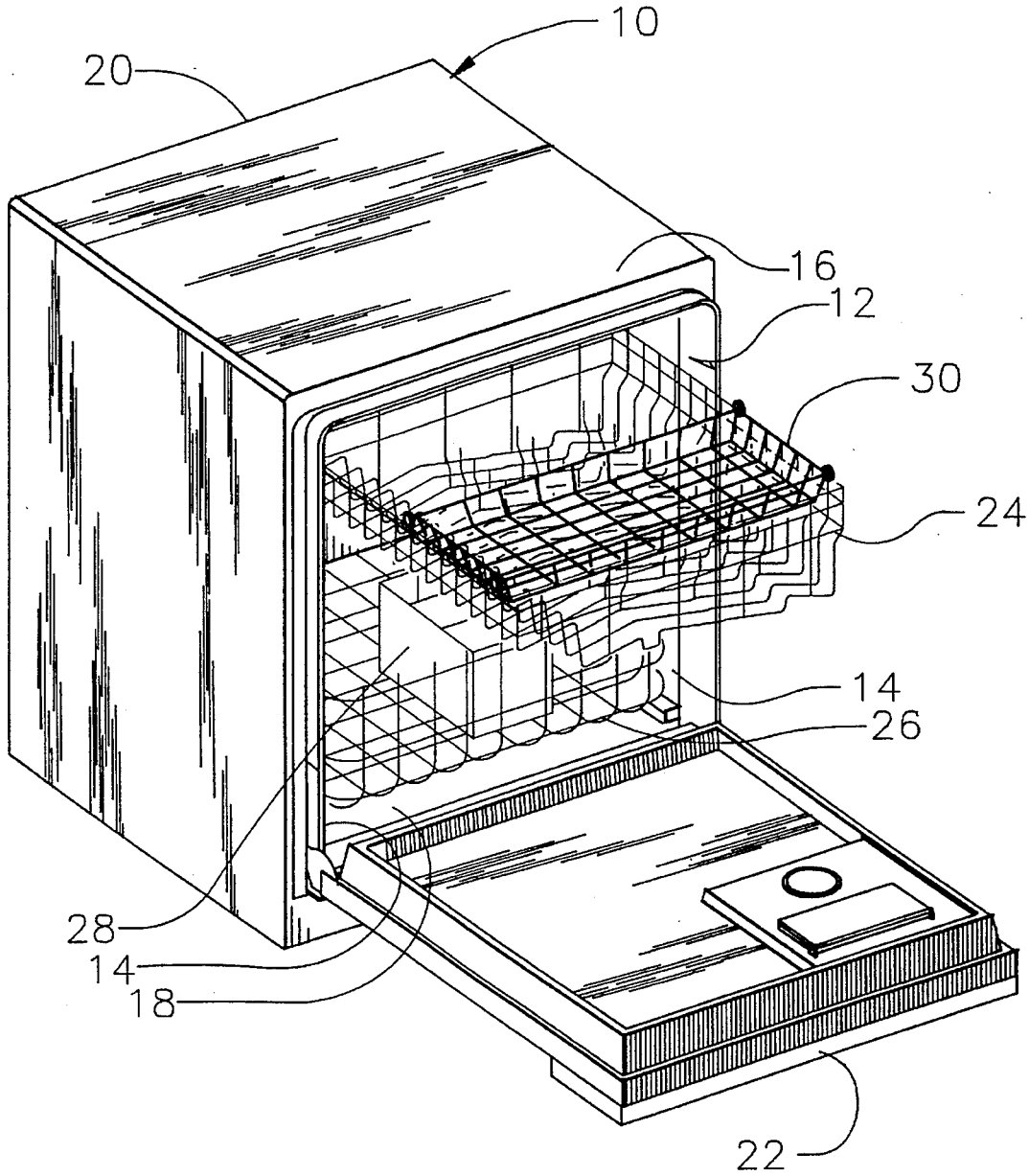
FIG. 1 is a perspective view of a dishwasher having a utensil tray in accordance with the present invention.
Figure 2:
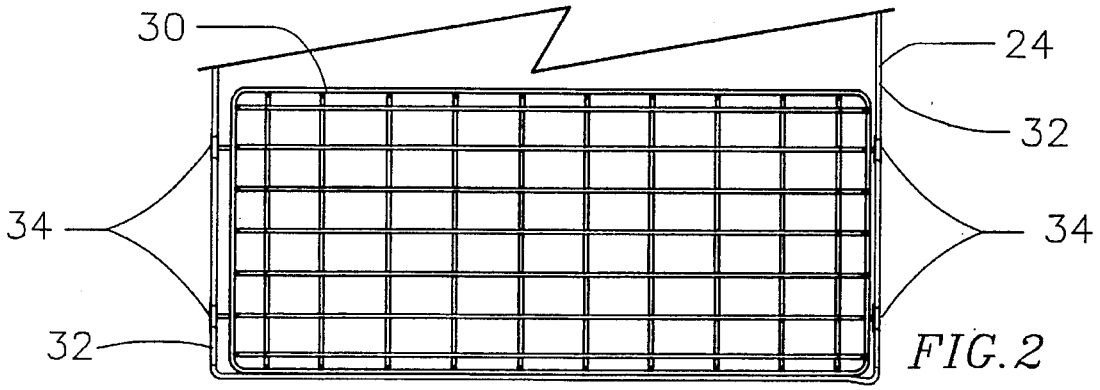
FIG. 2 is a top plan view of one embodiment of the utensil tray of the present invention, as positioned on the top rack of a dishwasher.
Figure 3:
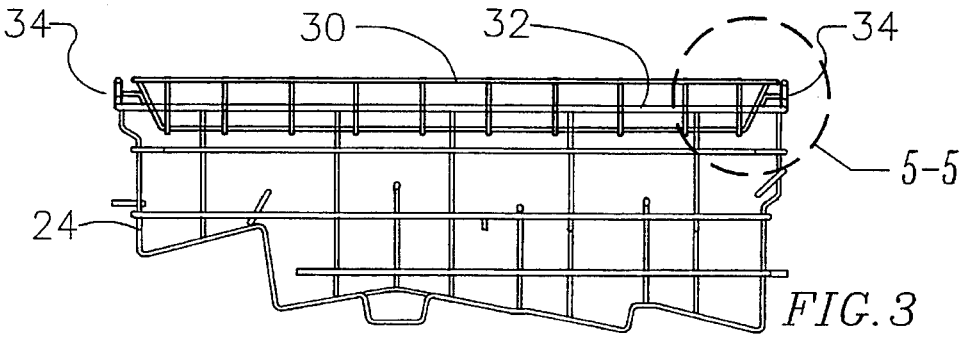
FIG. 3 is a front elevation view of the utensil tray of FIG. 2.

In the drawings, the reference numeral 10 generally designates a dishwasher. Dishwasher 10 has a washing chamber 12 defined by opposite side walls 14, a top wall 16, a bottom wall 18, a back wall 20, and a door 22. Door 22 is pivotally attached to the dishwasher so as to be movable between open and closed positions. Dishwasher 10 has an upper rack 24 and a lower rack 26. Racks 24 and 26 are usually a vinyl or nylon coated wire lattice structure adapted for holding plates, bowls, glasses, cups, pots, pans and other similar eating and cooking items. Racks 24 and 26 typically are supported by the side walls 14 of the dishwasher 10 and can be moved forwardly along tracks (not shown) so as to extend beyond the washing chamber 12 to provide for easy loading and unloading of the items being washed. Dishwasher 10 also includes a silverware basket 28 for holding knives, forks, spoons, and other similarly-shaped utensils.

The dishwasher 10, as described above, is conventional and does not constitute a part of the present invention.

The present invention is directed towards a utensil tray 30 which is adapted to hold odd-shaped utensils, such as spatulas, large serving spoons, ladles, tongs, long knives, mixer beaters, whips, and the like.

Utensil tray 30 is a substantially rectangular lattice structure adapted to be supported by one of racks 24 or 26 during loading and washing of utensils. In the drawings, tray 30 is shown to be supported on upper rack 24, but it is understood that the utensil tray can be supported on lower rack 26 in similar manners, as described below. Tray 30 can also be quickly and easily removed from the rack when not needed for odd-shaped utensils.

The support means for supporting utensil tray 30 upon one of racks 24, 26 may take several forms. The support means allows tray 30 to move along the upper perimeter edge 32 of the rack, either forwardly and rearwardly, as seen in FIGS. 1–13, or side-to-side, as seen in FIG. 14–17.

Figure 5:
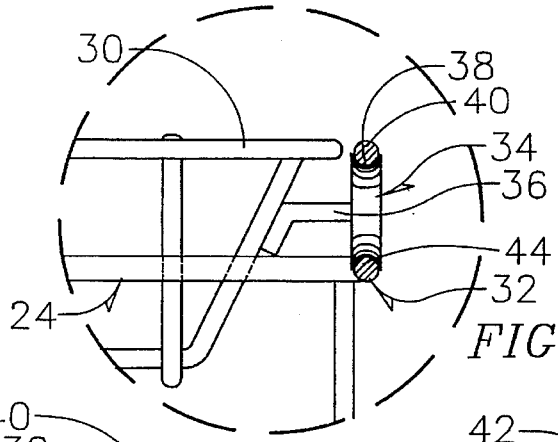
FIG. 5 is an enlarged view taken along lines 5—5 of FIG. 3.
Figure 4:
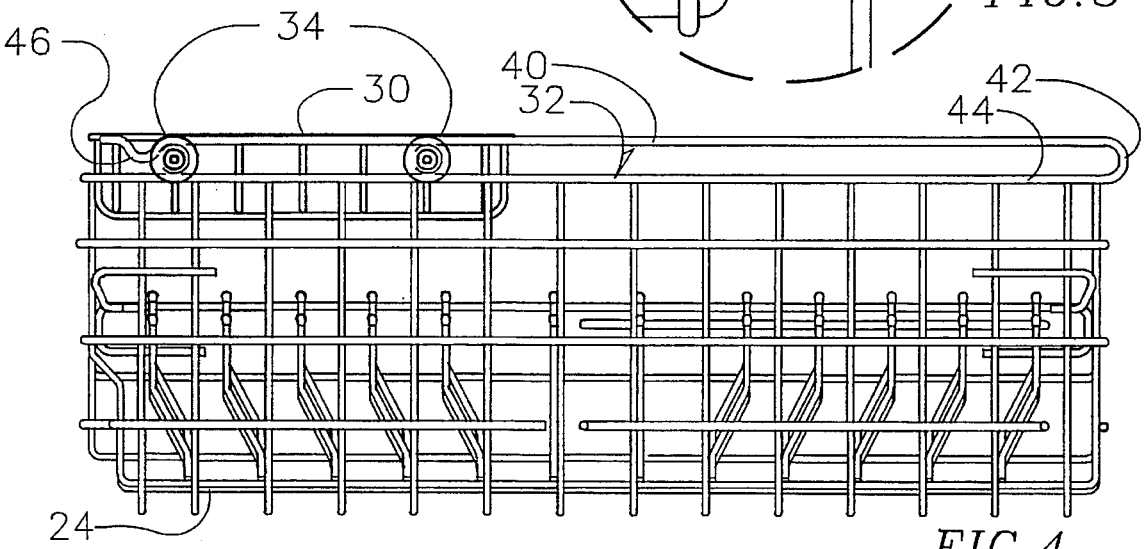
FIG. 4 is a side elevation view of the utensil tray of FIG. 2.
Figure 6:
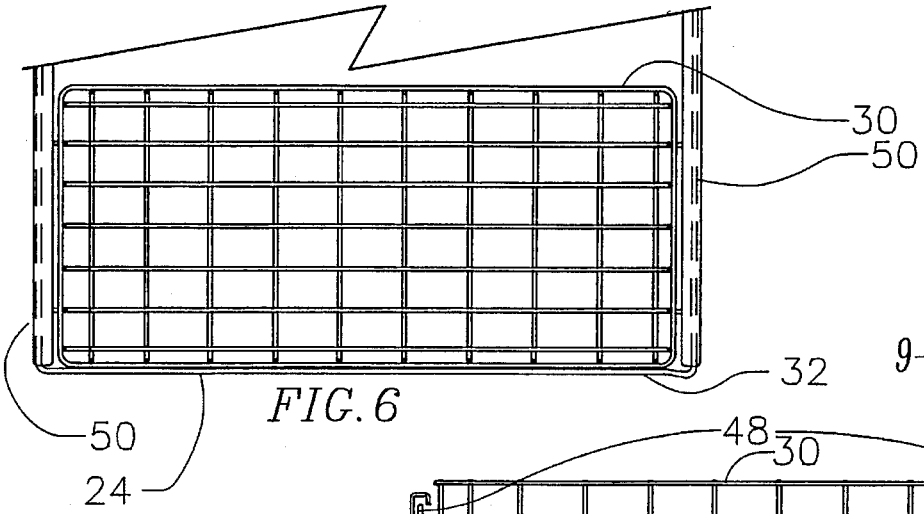
FIG. 6 is a top plan view of a second embodiment of the utensil tray of the present invention as positioned on the top rack of a dishwasher.
Figure 7:
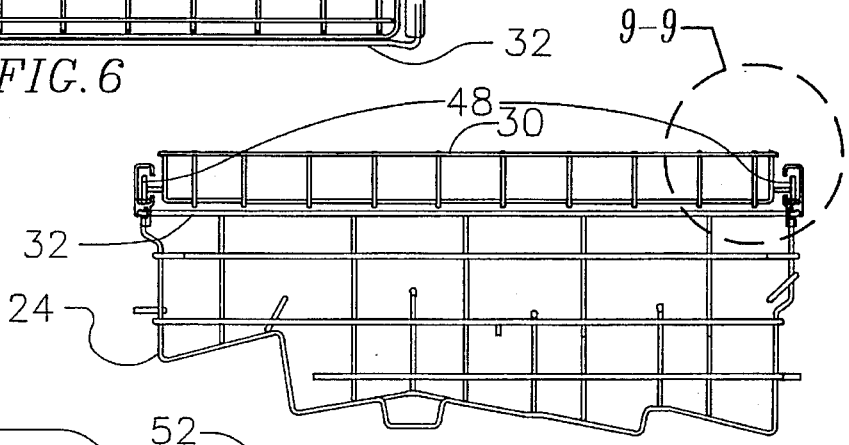
FIG. 7 is a front elevation view of the utensil tray shown in FIG. 6.

More particularly, as shown in FIGS. 2–5, one embodiment of the support means includes a plurality of rollers 34 mounted on axles 36 extending from the opposite sides of tray 30. Rollers 34 preferably have a cupped perimeter 38, as best seen in FIG. 5, for matingly rolling along the wire perimeter edge 32 of the rack 24. As seen in FIGS. 2–5, each side of rack 24 includes an upper wire element 40 having a rearward end 42 connected to the rearward end 44 of the wire edge 32 of rack 24. As seen in FIG. 4, wire 40 is preferably an integral extension of the edge 32 of rack 24. As such, wire 40 and upper edge 32 of rack 24 define a guide track for rollers 34. A detent or stop means 46 is provided near the forward end of wire 40 so as to prevent tray 30 from rolling forwardly off of rack 24. Wire 40 can be easily lifted upwardly to allow tray 30 to be removed from the rack. Wire 40 may be vinyl or nylon coated so as to match rack 24.

Modified embodiments of the utensil tray of the present invention and its support means are shown in FIGS. 6–17, with similar reference numerals being used to designate similar structure.

Figure 8:
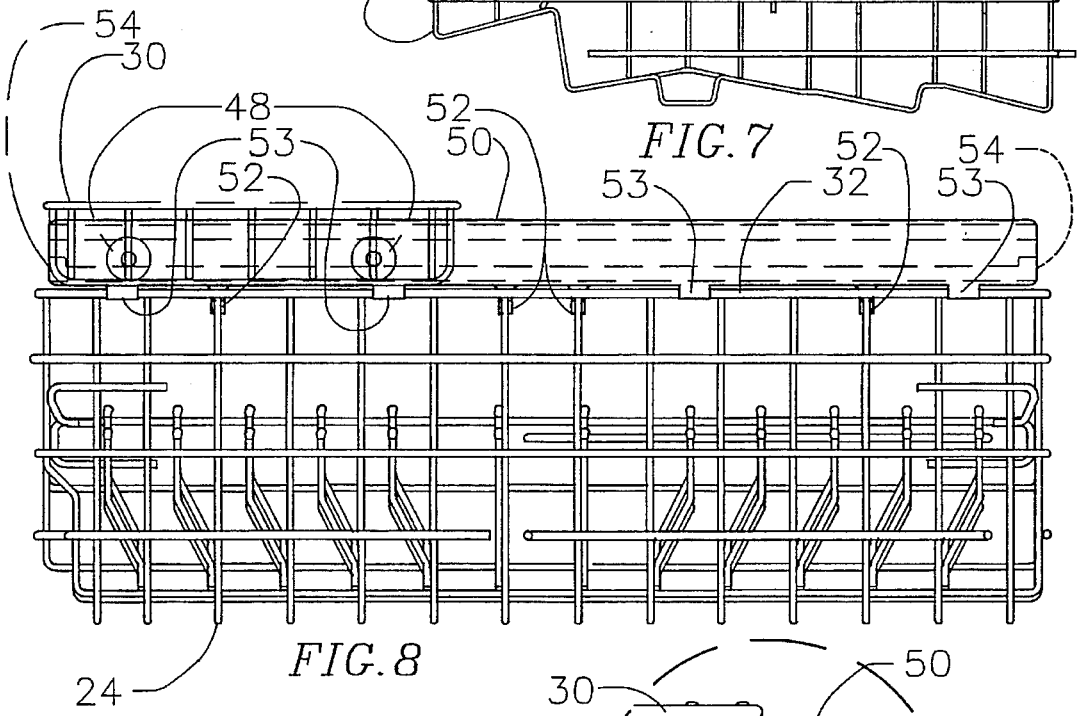
FIG. 8 is a side elevation view of the utensil tray shown in FIG. 6.
Figure 9:
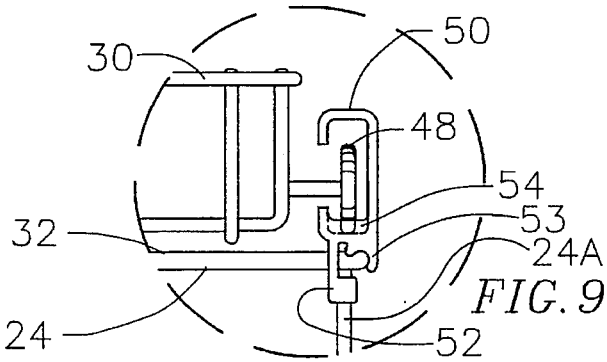
FIG. 9 is an enlarged view taken along lines 9—9 of FIG. 7.
Figure 10:
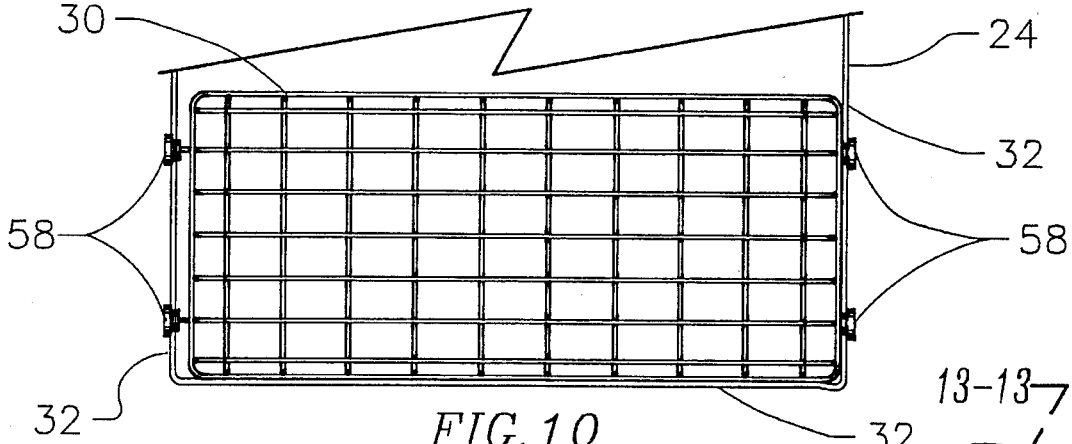
FIG. 10 is a top plan view of a third embodiment of the utensil tray of the present invention as positioned on the upper rack of a dishwasher.
Figure 11:
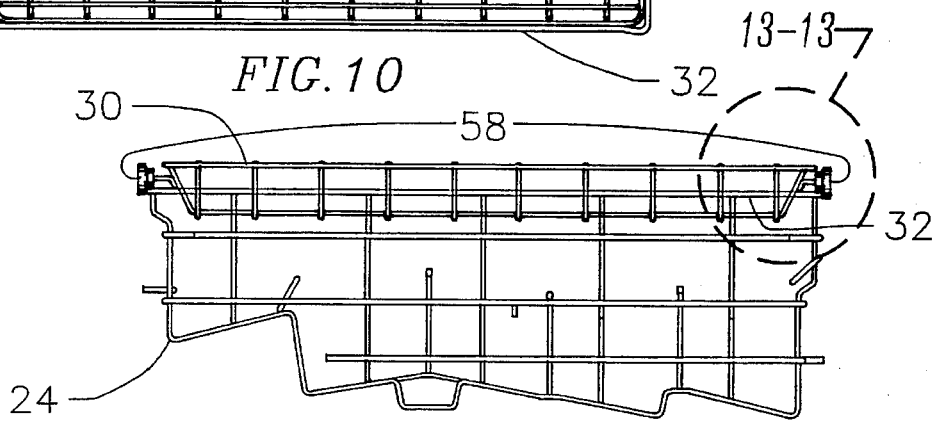
FIG. 11 is a front elevation view of the utensil tray of FIG. 10.

In FIGS. 6–9, a second embodiment of the utensil tray is illustrated. In this embodiment, tray 30 is provided with a plurality of rollers 48 at each side. Rollers 48 are rollably received within a C-shaped guide track 50 which is snap fit onto one of the racks 24 or 26. As best seen in FIGS. 8 and 9, guide track 50 includes a plurality of resilient snap members 52 which retentively engage upright members 24A of the lattice structure of the rack, and a plurality of support members 53 for retentively engaging the perimeter edge 32 of rack 24. Snap members 52 and support members 53 oppose one another so as to securely mount guide track 50 on rack 24. Guide track 50 is provided with a detent or stop means 54 at the forward and rearward ends thereof so as to prevent rollers 48 from rolling out of engagement with the guide track. Clearance is provided in guide track 50 so that rollers 48 can be lifted over the stop means 54, such that tray 30 can be removed from guide track 50.

Figure 12:
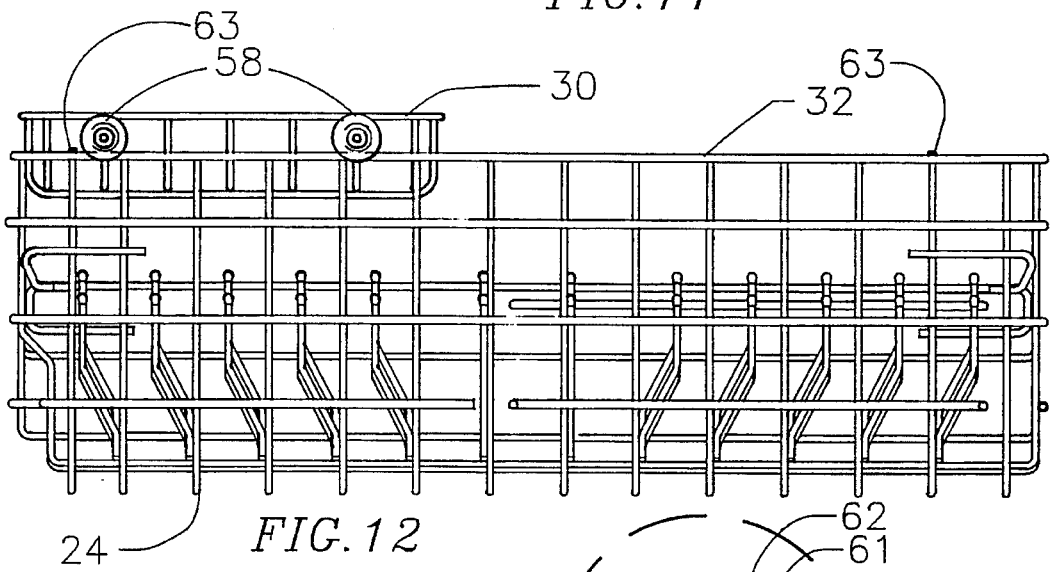
FIG. 12 is a side elevation view of the utensil tray of FIG. 10.
Figure 13:
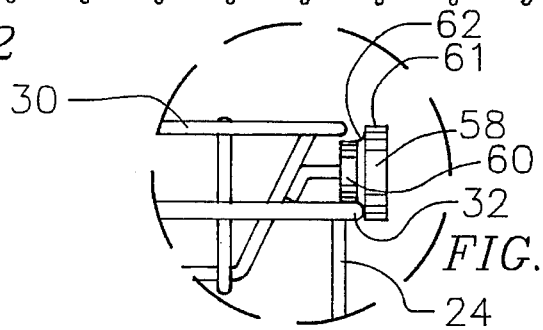
FIG. 13 is an enlarged view taken along lines 13—13 of FIG. 11.
Figure 14:
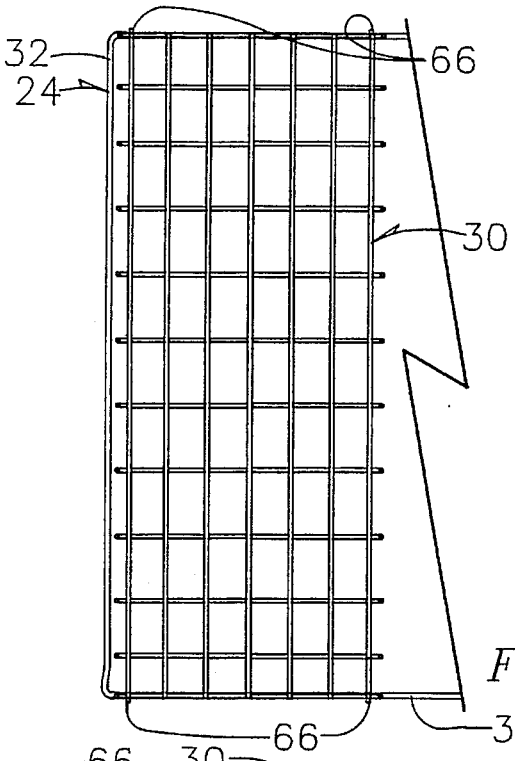
FIG. 14 is a top plan view of a fourth embodiment of the utensil tray of the present invention as positioned on the upper rack of a dishwasher.
Figure 17:
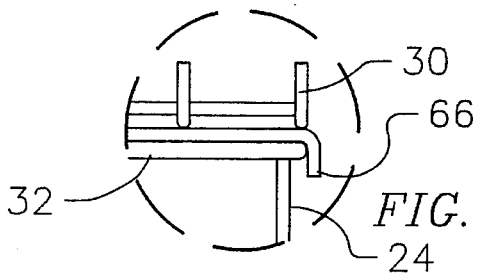
FIG. 17 is an enlarged view taken along lines 17—17 of FIG. 15.
Figure 15:
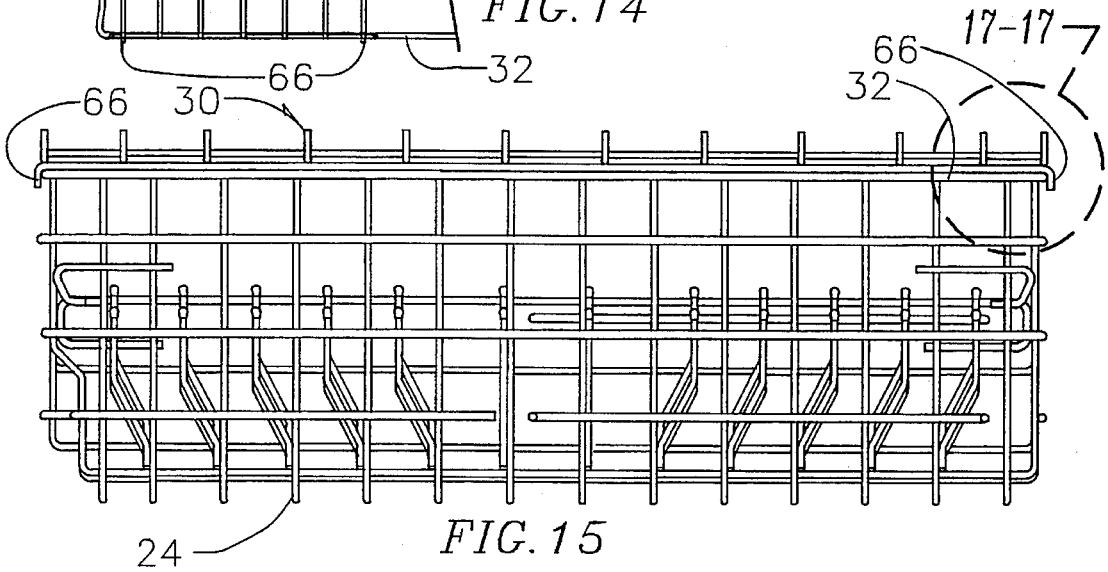
FIG. 15 is a side elevation view of the utensil tray shown in FIG. 14.
Figure 16:
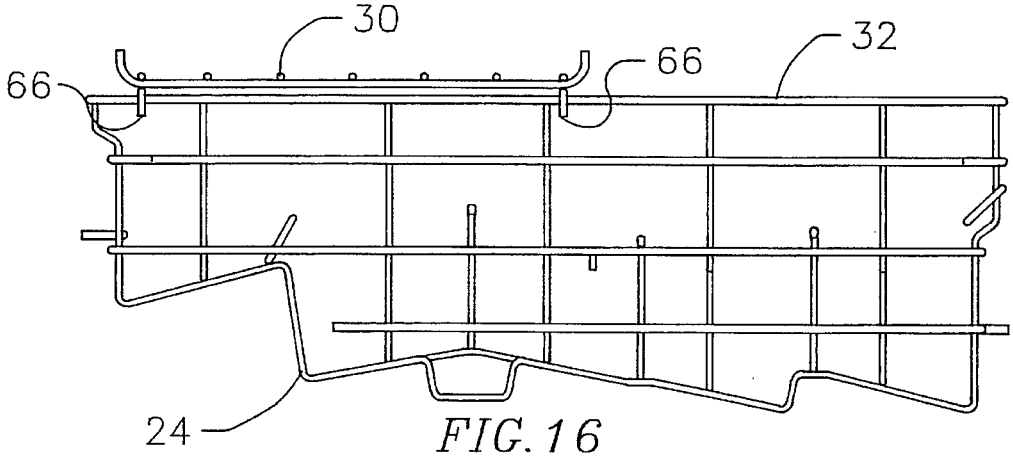
FIG. 16 is a front elevation view of the utensil tray shown in FIG. 14.

A third embodiment is shown in FIGS. 10– 13, wherein tray 30 is provided with a plurality of rollers 58. Rollers 58 include a small diameter portion 60 and an enlarged diameter portion 61 which define a shoulder 62 between the portions 60, 61, as seen in FIG. 13. The reduced diameter portions 60 of rollers 58 rollably engage the upper perimeter edge 32 of rack 24 while shoulders 62 act as a guide to keep the rollers 58 on the perimeter edge 32 of the rack 24. As best shown in FIG. 12, stop means 63 may be provided to limit the rolling movement of the tray 30 upon the rack 24. Also, in this embodiment, tray 30 can be easily lifted from rack 24 if no odd-shaped utensils need to be washed.

A fourth embodiment of the present invention is shown in FIGS. 14–17. More particularly, the support means for tray 30 includes a plurality of hooks 66 on front and rear ends of tray 30. Hooks 66 overlapping engage the upper perimeter edge 32 of one of the racks 24, 26. As shown in the drawings, hooks 66 overlap the front and rear edges of the rack 24 so that tray 30 is slidably movable from side-to-side. Alternatively, if the configuration of rack 24 is square, hooks 66 can overlappingly engage the opposite lateral sides of the rack 24, such that tray 30 can slidably move forwardly and rearwardly. Hooks 66 allow tray 30 to be easily lifted from the rack 24 when desired.

In use, when it is desirable to wash odd-shaped utensils which do not otherwise conveniently fit within silverware basket 28 or the racks, such utensils can be laid into tray 30 in a random pattern for washing. Tray 30 can be easily moved upon the rack for loading and unloading of other items in the rack below the tray. When necessary, tray 30 can be quickly and easily removed from the rack.

The preferred embodiment of the invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit or scope of the invention as further defined in the following claims.

We claim:

1. A utensil holder in combination with a dishwasher having opposite side walls, a rear wall, a front door, and at least one rack with an upper perimeter edge, the rack being movably mounted between the side walls for forward and rearward movement, the utensil holder comprising:

a tray for holding utensils to be washer;

tray support means for independently movably supporting the tray on the upper perimeter edge of the rack during loading of the utensils, the tray being horizontally movable relative to the rack and between a front position and a rear position completely within the confines of the perimeter edge of the rack; and the support means including rollers for rollably supporting the tray on the rack.

2. The utensil holder of claim 1 wherein the rack has opposite sides, and the tray extends between opposite sides of the rack.

3. The utensil holder of claim 1 wherein the rack has front and back sides, and the tray extends between the front and back sides of the rack.

4. The utensil holder of claim 1 wherein the tray is a substantially rectangular lattice structure.

5. The utensil holder of claim 1 wherein the support means supports the tray for lateral side-to-side movement.

6. The utensil holder of claim 1 wherein the support means supports the tray for forward and rearward movement.

7. The utensil holder of claim 1 wherein the tray is constructed of vinyl coated formed wire members.

8. The utensil holder of claim 1 wherein the support means includes track means connected to the rack for guiding the rollers.

9. The utensil holder of claim 1 wherein the support means includes stop means for limiting the movement of the rollers.

10. The utensil holder of claim 1 wherein the rollers are cupped for matingly engaging the upper edge of the rack.

11. The utensil holder of claim 1 wherein the support means includes hook means frictionally and slidably engaging the upper edge of the rack.

12. The utensil holder of claim 1 wherein the tray is molded of plastic.

13. The utensil holder of claim 1 wherein the rollers are cupped for matingly engaging the upper edge of the rack.

14. A utensil holder in combination with a dishwasher having a washing chamber and at least one dish rack within the washing chamber, the rack having upstanding walls with an upper edge defining a periphery of the rack, the utensil holder comprising:

basket means for receiving utensils to be washed;

basket support means overlying and engagable with the upper edge of the walls of the rack for movably supporting the basket means thereon, the basket means being movable horizontally between a first position and a second position relative to the walls of the rack and within the periphery of the rack, the basket means being supported solely by the upper edge of the walls of the rack during the horizontal movement; and the support means including a plurality of rollers operably engageable with the side walls of the rack for supporting the basket means and for facilitating movement of the basket means on the dish rack.

15. The utensil holding means according to claim 14 wherein the support means includes means defining a plurality of slide members operably engageable with the side walls of the rack for supporting the basket means thereon and for facilitating movement of the basket means on the dish rack.

16. An improved dishwasher having opposite walls defining a washing chamber, the improvement comprising:

a dish rack movably supported on the walls of the washing chamber, the rack having an upper periphery with opposite peripheral side edges and opposite peripheral front and back edges; and a utensil tray movably supported solely on the peripheral side edges of the dish rack for horizontal movement between a front position and a rear position relative to the rack, the movement being completely within the periphery of the rack.

17. The improved dishwasher of claim 16 further comprising stop means to limit horizontal movement of the tray on the rack.

18. The improved dishwasher of claim 16 further comprising support means for movably supporting the tray on the rack.

19. The utensil holder of claim 18 wherein the support means includes means defining a plurality of slide members operably engageable with the side walls of the rack for supporting the basket means thereon and for facilitating movement of the basket means on the dish rack.

20. The utensil holder of claim 18 wherein the support means includes hook means frictionally and slidably engaging the upper edge of the rack.

21. The utensil holder of claim 18 wherein the support means includes rollers adapted for rollably supporting the tray on the rack.

22. The utensil holder of claim 18 wherein the support means includes track means connected to the rack for guiding the rollers.

* * * * *